United States Patent [19]

Eder et al.

[11] Patent Number: 4,611,103

[45] Date of Patent: Sep. 9, 1986

[54] MEANS PROVIDING INTERMITTENT MOTION TO A CAM MEANS OF A TIMING MECHANISM AND HAVING SUB-INTERVAL SWITCHING MEANS

[75] Inventors: Robert L. Eder, Indianapolis; Donald L. Ray, Oaklandon, both of Ind.

[73] Assignee: Emhart Industries, Inc., Indianapolis, Ind.

[21] Appl. No.: 722,115

[22] Filed: Apr. 11, 1985

[51] Int. Cl.[4] ..... H01H 7/00

[52] U.S. Cl. ..... 200/38 B; 74/568 T

[58] Field of Search ..... 200/35 R, 38 R, 38 B, 200/37 A, 38 BA; 74/568 T; 368/108

[56] References Cited

U.S. PATENT DOCUMENTS

| | | | |
|---|---|---|---|
| 3,239,614 | 3/1966 | Simmons | 200/38 B |
| 4,246,454 | 1/1981 | Ray | 200/38 R |
| 4,536,626 | 8/1985 | Wojtanek | 200/35 R |

*Primary Examiner*—A. D. Pellinen
*Assistant Examiner*—Morris Ginsburg
*Attorney, Agent, or Firm*—Robert F. Meyer

[57] ABSTRACT

An intermittent drive includes a pair of reciprocating drive pawls which individually and alternately drive a camstack in a step by step maneuver. Electrical switches open and close in response to the camstack. One of the drive pawls includes a lost motion connection between it and a rotating member. There is a sub-interval switch having a cam disposed within the intermittent drive and a cam follower which operates a switch.

8 Claims, 9 Drawing Figures

MEANS PROVIDING INTERMITTENT MOTION TO A CAM MEANS OF A TIMING MECHANISM AND HAVING SUB-INTERVAL SWITCHING MEANS

BACKGROUND OF THE INVENTION

The present invention relates generally to a timing mechanism and more particularly to an intermittent drive means for such a timing mechanism which is particularly adaptable to the use of a sub-interval switch in the timing mechanism.

Timing mechanisms have been used for years to control the functions of appliances such as washers and dishwashers. As the demands for controlling the functions of the appliance become more complicated, ways and means need to be found to render the timing mechanism more versatile. Sub-interval switching has been one way of providing greater versatility. Such a mechanism introduces a timed interval substantially smaller in magnitude than the basic impulse time of the timing mechanism itself. In the case of an automatic washing machine, for example, it may be necessary to introduce a shorter period of rinse water into the machine during its spin function.

In order to gain maximum use of sub-interval switching, the drive means for the main camstack must be such that it quickly advances the camstack and it must be such that it allows for synchronization of the sub-interval with the drive cycle.

SUMMARY OF THE INVENTION

Accordingly, these problems have been solved by providing a timing mechanism which, in general, comprises a motor drive means, a first cam means and first electrical switch means opening and closing in response to the first cam means, intermittent drive means coupled to the motor drive means and including first and second reciprocating drive pawls carried by first and second rotating members and alternately driving the first cam means in a step by step manner, and a sub-interval switch means including a second cam means disposed within the intermittent drive means, and second switch means opening and closing in response to the second cam means.

DETAILED DESCRIPTION OF THE INVENTION

Figure 1:
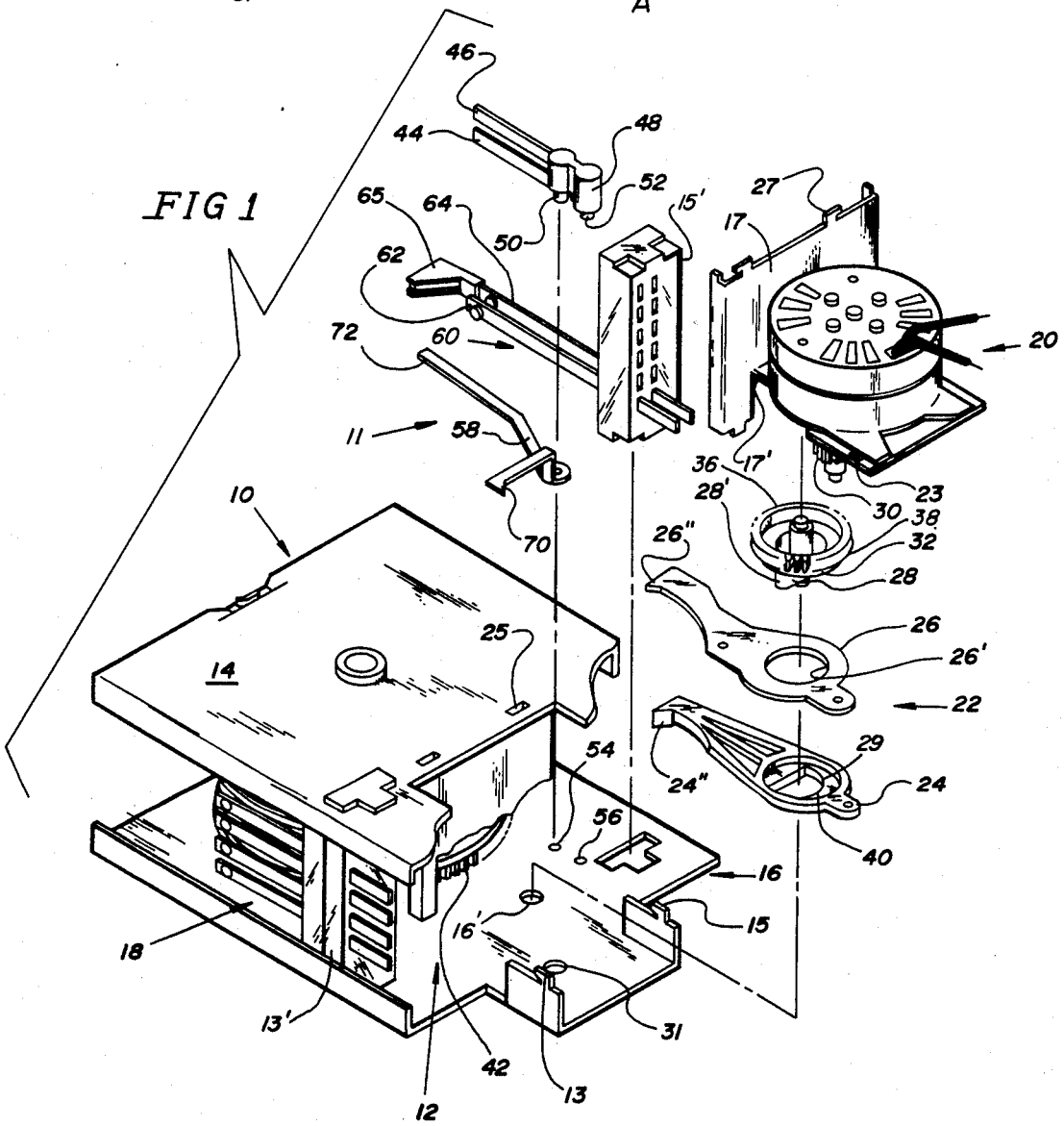
FIG. 1 is an exploded view of a timing mechanism employing the features of the invention.

Referring now to FIG. 1, there is shown a timing mechanism 10 employing the features of the invention. Timing mechanism 10 in general includes a cam means 12 rotatably journalled between end plates 14 and 16, electrical switch means 18 and another similar switch means located on an opposite side of the timing mechanism which engage and are responsive to the cam means 12, a motor drive means 20 carried by end plate 16 through motor mounting plate 17, intermittent drive means 22 coupling the motor drive means to the cam means 12 to impart intermittent rotations thereto and sub-interval switch means 11 (FIGS. 3–6). Switch means 18 is carried in terminal block 13' and the similar one on the opposite side of the timing mechanism is carried in terminal block 15'. Sub-interval switch means 11 is located on the side of the timing mechanism opposite the illustrated electrical switch means.

Motor drive means 20 includes a motor 19 which may be of the synchronous type and a gear train carried in housing 21 to provide a desired output speed from motor output pinion 30. It is mounted on end plate 16 through tangs 13 and 15 engaging opposed slots 23. Similar tangs 27 engage slots 25 in plate 14. Output pinion 30 is journalled in aperture 31.

Figure 2:
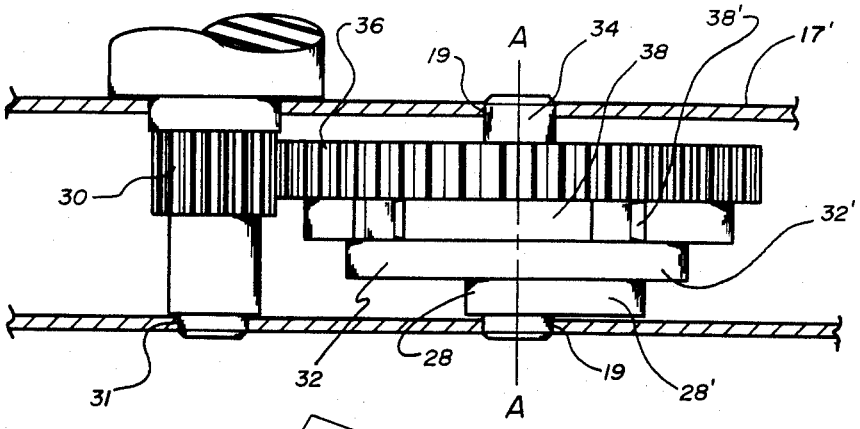
FIG. 2 is a partial section showing the intermittent drive means and a sub-interval cam of the present invention.

Referring to FIGS. 1 and 2, intermittent drive means 22 includes a pair of drive pawls 24 and 26 which are driven in a reciprocating motion through rotating members 28 and 32. Rotating members 28 and 32 are fixedly carried on a shaft 34 which is rotatably carried between aperture 16' of plate 16 and the base 17' of motor mounting plate 17. Also carried on shaft 34 is a gear 36 which meshes with motor output pinion 30 and a sub-interval cam 38. In the illustrative embodiment gear 36, sub-interval cam 38 and rotating members 28 and 32 as well as shaft 34 are all of a one-piece construction.

Rotating member 28 includes a wedge shaped cam 28' which has the axis A—A of shaft 34 as its axis of rotation. The cam extends from rotating member 28. As will become apparent with reference to FIGS. 3–6, cam 28' rotates within a cam follower 29 comprising a D-shaped aperture 40 of drive pawl 24. The wedge shaped cam in cooperation with the D-shaped aperture provides a lost motion connection between the rotating member and the drive pawl. Rotating member 32 includes a circular disc 32' which rotates on an axis that is off center, or eccentric to the axis A—A of shaft 34. Drive pawl 26 is carried on rotating member 32 through aperture 26' of the pawl. Both drive pawls 24 and 26 engage ratchet 42 of cam means 12 through their toothed distal ends 24'' and 26'' to alternately advance the cam means. The pawls are spring biased against ratchet 42 through individual springs 44 and 46. Springs 44 and 46 are carried in and extend from a block 48 that is fixed in plate 16 through pins 50 and 52 engaging apertures 54 and 56. A clamp (not shown) may be used to further insure that the block is held in place.

Sub-interval cam 38 in cooperation with follower 58 opens and closes a separate switch 60 to provide sub-interval switching means 11. Switch 60 includes contact blades 62 and 64 each having matching electrical contacts 66 and 68 which engage one another and a plastic cam follower 65. Follower 58 is pivotly mounted on pin 50 through aperture 51. Its toothed distal end 70 engages sub-interval cam 38 which has notches 38' in its cam surface. The other distal end 72 engages blade 64 to open and close the electrical contacts. As will be apparent, when distal end 70 engages a notch 38' of cam 38, switch 60 will close.

Figure 3:
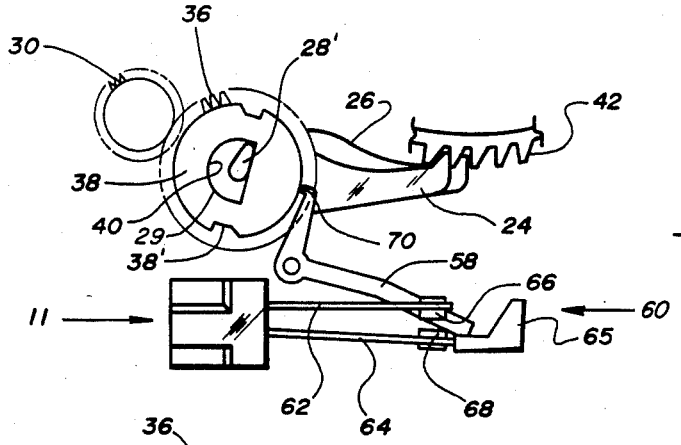
FIGS. 3–6 are sections showing different operating positions of the intermittent drive means and the sub-interval switch means.
Figure 4:
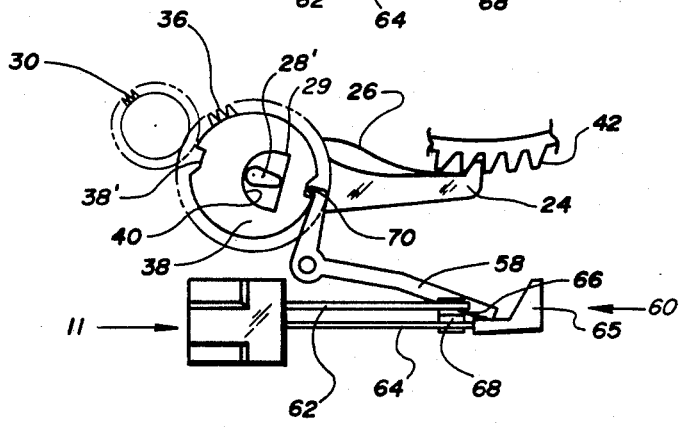
Figure 5:
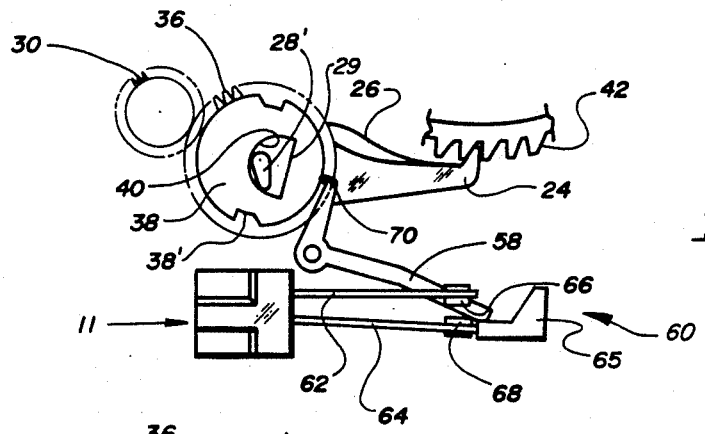
Figure 6:
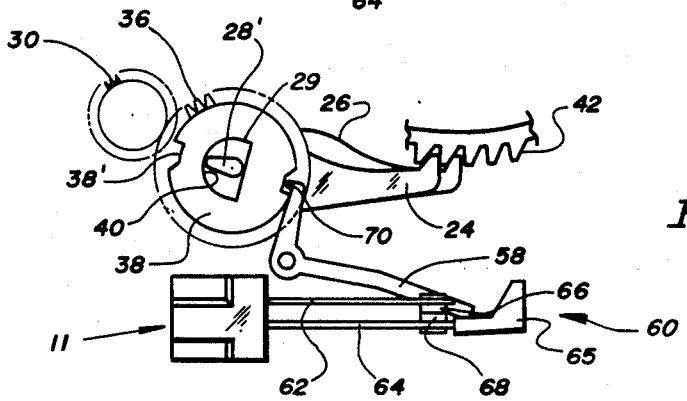

The operation of the timing mechanism can now be described with reference to FIGS. 3–6. In the illustrative embodiment shown, gear 36 is being driven clockwise through motor output pinion 30 with the drive pawls 24 and 26 driving ratchet 42 of cam means 12 counterclockwise. In FIG. 3, drive pawl 26 has engaged ratchet 42 to advance cam means 12, while wedge shaped cam 28' is nearing the flat side of the D-shaped aperture to being to drive pawl forward to begin to engage ratchet 42. The distal end 70 of follower 58 is riding on the outer rim of cam 38 and therefore sub-interval switch 60 is open. In FIG. 4, wedge shaped cam 28' has engaged the flat face of the D-shaped aperture to fully extend drive pawl 24 to rapidly advance ratchet 42 and thus the cam means. Drive pawl 26 has been retracted. Follower 58 has engaged a notch 38' of sub-interval cam 38 to close switch 60. In FIG. 5, wedge shaped cam 28' has begun to engage the curved portion of D-shaped aperture 40 to begin retraction of drive pawl 24. Drive pawl 26 has moved forward to drive ratchet 42 and switch 60 has been opened. In FIG. 6, drive pawl 24 has reached the low point of the curved portion to fully retract drive pawl 24. Drive pawl 26 is fully extended and follower 58 has again engaged a notch 38' to close switch 60. Each advancement of ratchet 42 advances cam means 12 (FIG. 1) to open and close electrical switch means 18.

Figure 7:
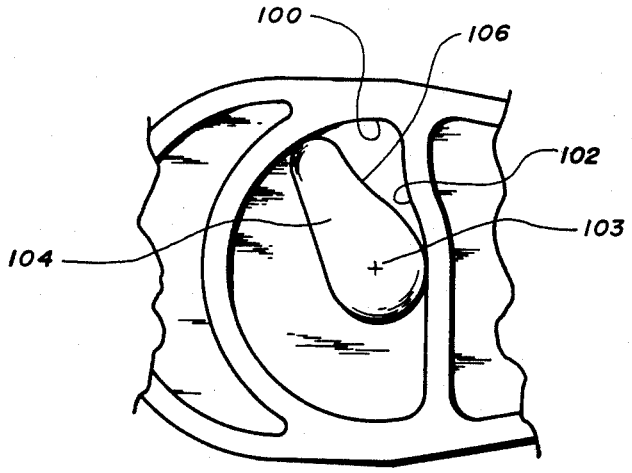
FIGS. 7–9 illustrate different embodiments of a cam and cam follower used in the intermittent drive means.
Figure 8:
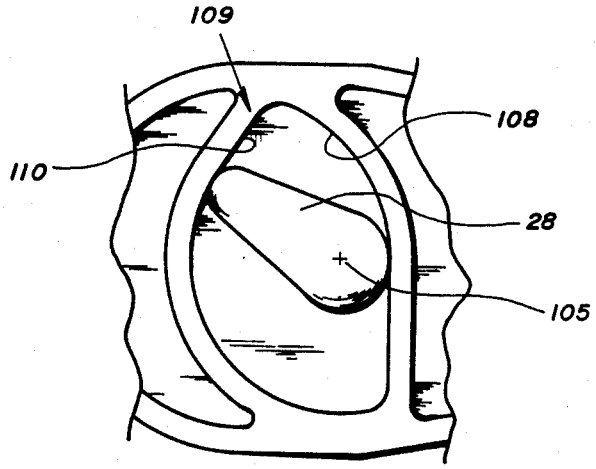
Figure 9:
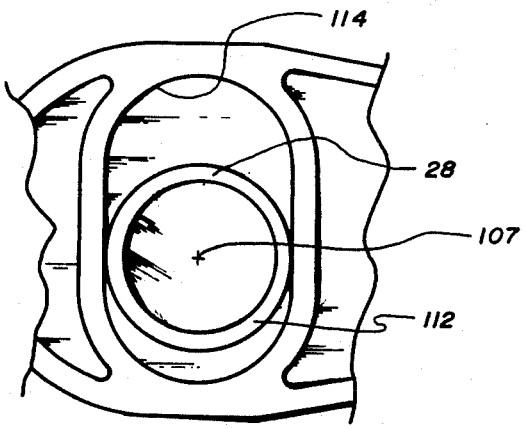

Referring now to FIGS. 7–9 there are shown different embodiments of the cam 28 and cam follower 29 illustrated in FIGS. 3–6. As shown in FIG. 7, cam follower 100 includes a smooth rise portion 102 in the flat edge side of the D-shaped aperture of FIGS. 3–6 and cam 104 includes a slightly concave surface 106 formed in the wedge shaped cam of FIGS. 3–6. The concave portion provides a relief for the rise 102. The axis of rotation 103 of cam 104 is the same as axis A—A of FIG. 2. In the embodiment of FIG. 8, cam 28' is the same as that of FIGS. 3–6 with an axis of rotation 105 being the same as axis A—A, while the aperture of cam follower 108 has a portion of the D-shaped apertures of FIGS. 3–6 taking on an ovate form 109 with a portion 110 thereof being substantially flat. In FIG. 9, cam 112 is a circular ledge extending from rotating member 28 and cam follower 114 is an oblong circle. The axis of rotation 107 of the circular ledge is also the same as axis A—A.

These embodiments of the drive system provide different ratios of pawl advance time and pawl retract time of drive pawl 24. Thus not only does cam means 12 provide a timed program, but the drive pawls also contribute to such programs. In the embodiments of FIGS. 3–6, 80° of rotation of cam 28' advances the drive pawl to its full extent while for 280° the drive pawl idles or retracts. Thus the ratio of advance to idle/retract is 3.5 to 1. Therefore, for a 60 second interval time, the pawl advance drive time would be 13.33 sec. and the idle/retract time would be 46.67 sec.

For the configuration of FIG. 7, 60° of rotation advances the drive pawl to its full extent such that the ratio of advance to idle and retract would be 5 to 1 and the advance time would be 10 sec. and the idle/retract time would be 50 sec. for a 60 second interval. For the configuration of FIG. 8, 110° of rotation advances the pawl to its full extent such that the ratio would be 2.27 to 1 and the advance time would be 18.35 sec. and the idle/retract time would be 41.65 sec. for a 60 second interval. And for the configuration of FIG. 9, 180° of rotation advances the pawl to its full extent such that the ratio would be 1 to 1, and the advance time and the idle/retract time would each be 30 seconds for a 60 second interval.

The ratios are all proportional such that additional time intervals of 90 and 120 seconds can be used.

What is claimed is:

1. A timing mechanism comprising (a) motor drive means, (b) a cam means and electrical switches opening and closing in response to said cam means, (c) a shaft, (d) a combination intermittent drive means and sub-interval drive means carried on said shaft including first and second rotating members carried on said shaft, first and second drive pawls coupled to and driven by said first and second rotating members and engaging said cam means to drive same in a reciprocating manner, a sub-interval drive cam carried on said shaft, and a cam follower engaging said sub-interval drive cam, and (e) sub-interval switch means biased by said cam follower to open and close said sub-interval switch means.

2. A timing mechanism according to claim 1 wherein said first drive pawl is carried by said first rotating member through a lost motion connection.

3. A timing mechanism according to claim 2 wherein said lost motion connection comprises a D-shaped aperture in said first drive pawl and a wedge shaped cam rotating within said D-shaped aperture.

4. A timing mechanism according to claim 3 wherein said wedge shaped cam has a concave surface in one of its sides and said D-shaped aperture includes a smooth rise portion in a flat edge side of said D-shaped aperture.

5. A timing mechanism according to claim 3 wherein said D-shaped aperture takes on an ovate configuration with a portion of the ovate configuration being substantially flat.

6. A timing mechanism according to claim 2 wherein said lost motion connection includes an oblong circular aperture and a circular cam rotating within said oblong circular aperture.

7. A timing mechanism according to claim 1 wherein said second rotating member has an axis of rotation eccentric to the axis of rotation of said first rotating member.

8. A timing mechanism according to claim 1 wherein said first and second rotating members and said second cam means are unitarily constructed on a shaft.

* * * * *